US008634961B2

(12) United States Patent
Lee et al.

(10) Patent No.: US 8,634,961 B2
(45) Date of Patent: Jan. 21, 2014

(54) SYSTEM AND METHOD FOR CONTROLLING FANS AND FAN HAVING THE SYSTEM

(75) Inventors: Hou-Hsien Lee, Tu-Cheng (TW); Chang-Jung Lee, Tu-Cheng (TW); Chih-Ping Lo, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 244 days.

(21) Appl. No.: 13/151,352

(22) Filed: Jun. 2, 2011

(65) Prior Publication Data

US 2012/0265347 A1 Oct. 18, 2012

(30) Foreign Application Priority Data

Apr. 12, 2011 (TW) ..... 100112532

(51) Int. Cl.

| | |
|---|---|
| ***G05B 15/00*** | (2006.01) |
| ***G05B 19/00*** | (2006.01) |
| ***G05D 1/02*** | (2006.01) |
| ***G05D 1/10*** | (2006.01) |
| ***B60H 1/00*** | (2006.01) |
| ***G06K 9/32*** | (2006.01) |

(52) U.S. Cl.

USPC ..... 700/259; 700/302; 165/202; 382/118; 382/294

(58) Field of Classification Search

USPC ..... 700/258, 259, 275, 276, 278, 302; 165/200–202; 340/1.1, 5.1, 5.2, 340/5.51–5.53, 425.5; 348/222.1, 370; 382/100, 115, 118, 276, 293–295, 298, 382/299

See application file for complete search history.

(56) References Cited

U.S. PATENT DOCUMENTS

| | | | | |
|---|---|---|---|---|
| 5,838,839 | A * | 11/1998 | Seki et al. | 382/299 |
| 5,991,429 | A * | 11/1999 | Coffin et al. | 382/118 |
| 6,879,879 | B2 * | 4/2005 | Jouppi et al. | 700/259 |
| 7,127,086 | B2 * | 10/2006 | Yuasa et al. | 382/118 |
| 7,255,161 | B2 * | 8/2007 | Durach et al. | 165/202 |
| 7,821,382 | B2 * | 10/2010 | Kameyama | 340/425.5 |
| 7,868,924 | B2 * | 1/2011 | Matsushita et al. | 348/222.1 |
| 8,102,465 | B2 * | 1/2012 | Nakao et al. | 348/370 |
| 2002/0109579 | A1 * | 8/2002 | Pollard et al. | 340/5.53 |
| 2003/0107650 | A1 * | 6/2003 | Colmenarez et al. | 348/150 |
| 2012/0170817 | A1 * | 7/2012 | Yang et al. | 382/118 |

FOREIGN PATENT DOCUMENTS

JP 2007106290 A * 4/2007

* cited by examiner

*Primary Examiner* — Crystal J Barnes-Bullock
(74) *Attorney, Agent, or Firm* — Altis Law Group, Inc.

(57) ABSTRACT

A fan includes a number of fan blades, a casing, a first actuating device, a second actuating device, a camera, and a controlling system. The first actuating device drives the fan blades. The second actuating device makes the fan change direction, thus to adjust a direction of wind from the fan. The camera captures an image of a scene at front of the fan. The controlling system checks the image to determine whether there is a person in the image, and to determine a position of the person in the image and outputs a corresponding position signal to the second actuating device for controlling the fan to change the direction of the wind from the fan.

6 Claims, 5 Drawing Sheets

SYSTEM AND METHOD FOR CONTROLLING FANS AND FAN HAVING THE SYSTEM

BACKGROUND

1. Technical Field

The present disclosure relates to a system and a method for controlling a fan, and a fan with the system.

2. Description of Related Art

A fan is usually placed in a fixed position when in use. When a person moves to another position or outside of the oscillating angle or range of the fan, wind from the fan may not blow onto the person, or may blow only intermittently onto the person. Thus the person must reposition the fan. This is an inconvenience.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
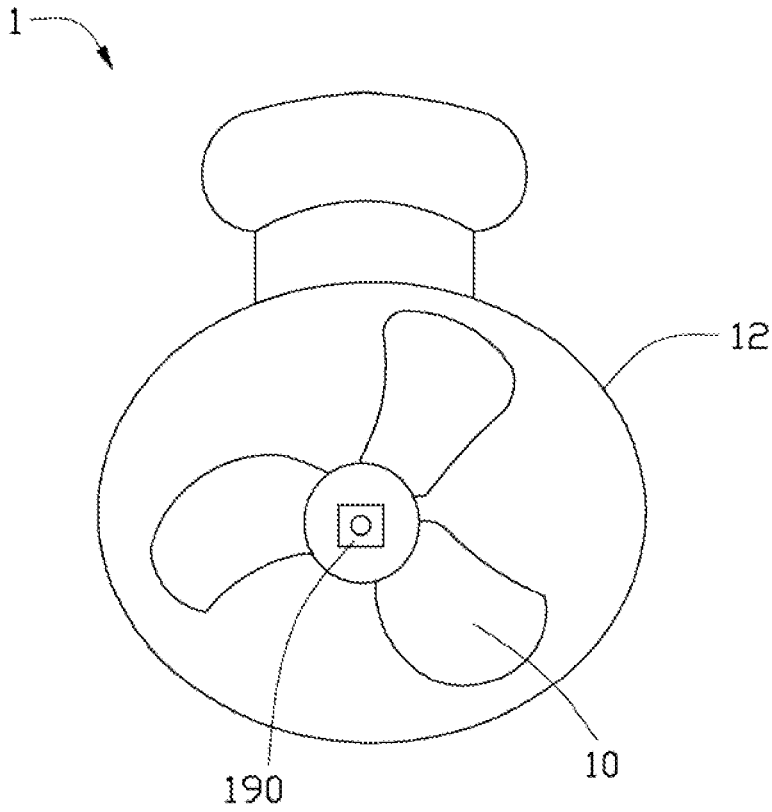
FIG. 1 is a schematic diagram of an exemplary embodiment of a fan.
Figure 2:
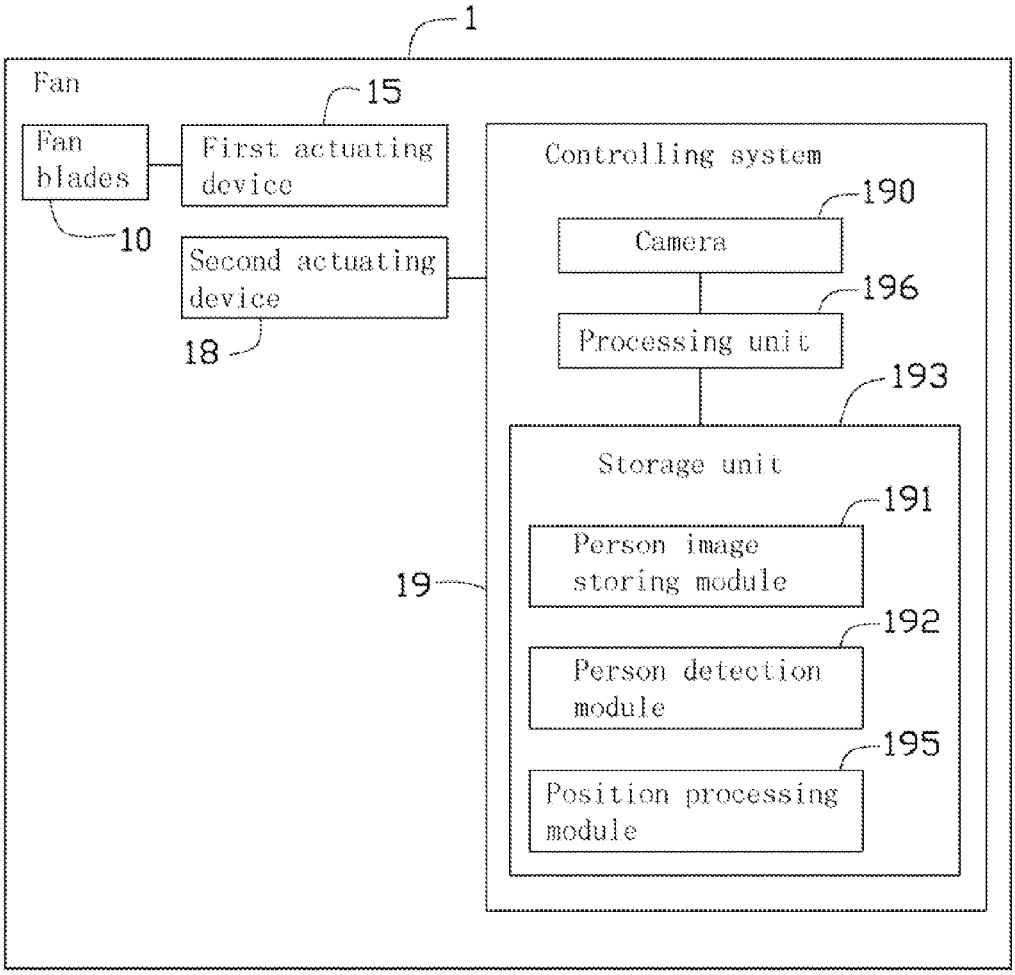
FIG. 2 is a block diagram of the fan of FIG. 1.

Referring to FIGS. 1 and 2, an exemplary embodiment of fan 1 includes a plurality of fan blades 10, a casing 12, a first actuating device 15, a second actuating device 18, and a controlling system 19. In the embodiment, the first actuating device 15 drives the fan blades 10. The second actuating device 18 can rotate the fan 1 to direct airflow from the fan 1.

The controlling system 19 includes a camera 190, a processing unit 196, and a storage unit 193. The camera 190 is mounted on the casing 12, thus to capture an image of the area in view of the camera 190.

The storage unit 193 includes a person image storing module 191, a person detection module 192, and a position processing module 195, which may include computer code to be executed by the processing unit 196.

The person storing module 191 stores a number of images of different shapes that are recognizable as people. The camera may be used to obtain the different person images in advance.

The person detection module 192 compares shapes in images captured by the camera 190 with the pre-stored images using well known person recognition technology to determine the presence of people in view of the camera 190. In the embodiment, the person detection module 192 compares the image captured by the camera 190 with the different person images stored in the person image storing module 191 to determine whether the captured image is a person. If a portion of the image captured by the camera 190 is similar to a person image of the person images stored in the person image storing module 191, it is determined that there is a person in the image, namely, there is a person front of the fan 1. If the image captured by the camera 190 is different from all person images stored in the person image storing module 191, it is determined that there is no person in the image, namely, there is no person at the front of the fan 1. Of course, in other embodiments, the person detection module 192 can use other well known person detection technology to check that whether there is a person in the image captured by the camera 190. At this time, the person image storing module 191 can be omitted.

The position processing module 195 determines the position of any detected person in the image, and outputs a corresponding position signal. The second actuating device 18 is connected to the control system 19 for receiving the position signal from the position processing module 195. The second actuating device 18 aims the fan 1 according to the position signal.

Figure 3:
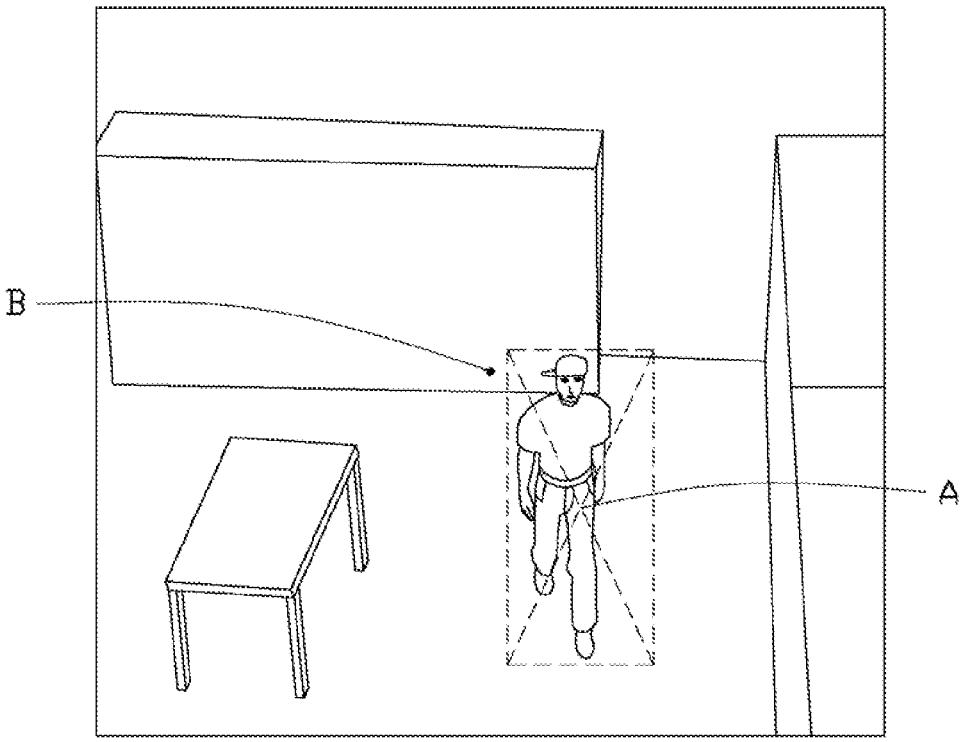
FIGS. 3 and 4 are illustrations of the fan in use.

Referring to FIG. 3, when the fan 1 is turned on, the control system 19 is activated. The camera 190 captures an image of the area in view of the camera 190. The person detection module 192 checks the image obtained by the camera 190 to determine that there is a person in the image, and outlines the person within a dashed box.

The position processing module 195 processes the image to obtain a center of the person, namely the center of the dashed box in the image, and marks the center of the person as point A. The position processing module 195 further processes the image to obtain the center of the scene, namely the center of the image obtained by the camera 190, and marks the center of the scene as point B.

The position processing module 195 compares the positions of the point A and the point B, and outputs a corresponding position signal. For example, in FIG. 3, the point A is to the right and below point B. As a result, the position processing module 195 outputs a corresponding position signal to make the second actuating device 18 control the fan 1 to point it towards the point A.

As the fan 1 moves to aim at point A, the shooting angle of the camera 190 changes correspondingly. As a result, distance between the point A and the point B in the image captured by the camera 190 decreases.

Figure 4:
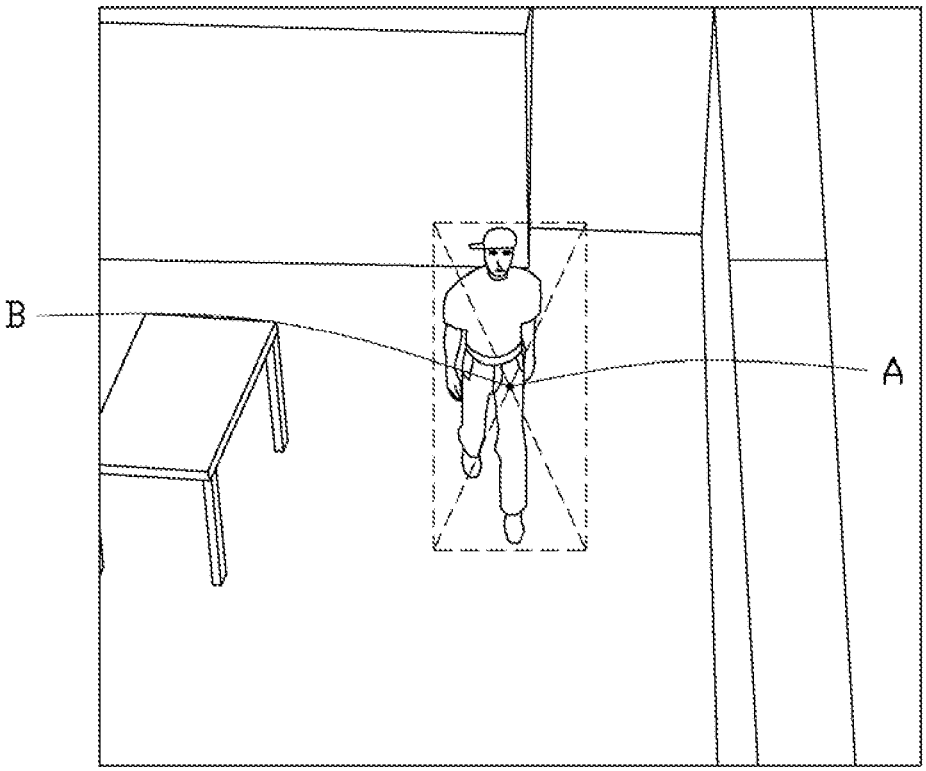

Referring to FIG. 4, when the point A overlaps the point B in the image captured by the camera 190, the position processing module 195 outputs a position signal to stop the movement of the second actuating device 18. At this time, the fan 1 is aimed the person.

In addition, if a group of people is detected in the image captured by the camera 190, the position processing module 195 marks the center of the group of people as point A. As a result, after the process described above, the fan 1 would face the center of the group of people.

Figure 5:
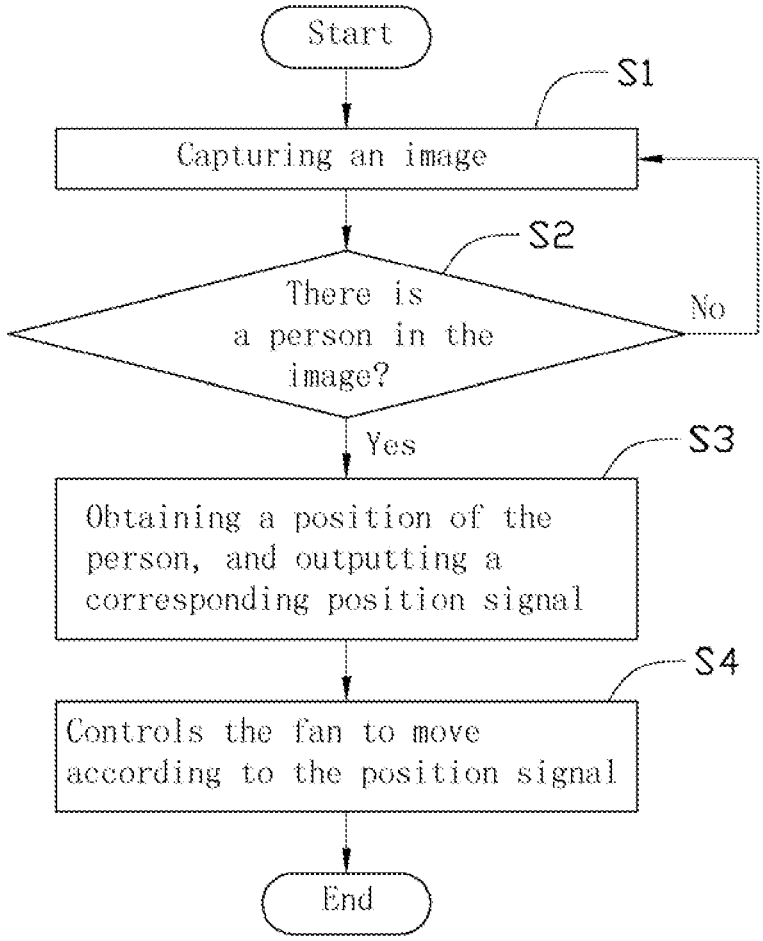
FIG. 5 is a flowchart of an exemplary embodiment of a method for controlling the fan of FIG. 1.

Referring to FIG. 5, an exemplary embodiment of a method for controlling the fan 1 includes the following steps.

In step S1, the camera 190 captures an image of the scene at front of the fan 1.

In step S2, the person detection module 192 checks the image to determine whether there is a person in the image. If there is no person in the image, it returns to step S1. If there is a person in the image, it flows to step S3.

In step S3, the position processing module 195 processes the image to obtain the position of the person, and outputs a corresponding position signal. In the embodiment, the position processing module 195 processes a relationship between a center of the box surrounding the person and a center of the image to obtain the position of the person.

In step S4, the second actuating device 18 controls the fan 1 to move according to the position signal.

The foregoing description of the exemplary embodiments of the disclosure has been presented only for the purposes of illustration and description and is not intended to be exhaustive or to limit the disclosure to the precise forms disclosed. Many modifications and variations are possible in light of everything above. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A system for controlling a fan, the system comprising:

a camera mounted on the fan, to capture an image of a scene in front of the fan;

a processing unit connected to the camera to receive the image; and a storage unit connected to the processing unit and storing a plurality of programs to be executed by the processing unit, wherein the storage unit comprises:

a person detection module to check the image captured by the camera to determine whether there is a person in the image, and outlines the person within a dashed box; and a position processing module to determine a position of the person in the image, and output a corresponding position signal to an actuating device of the fan for controlling the fan to change a direction of wind from the fan;

wherein the position processing module processes the image to obtain a center of the dashed box in the image and marks the center of the dashed box as a first point, the position processing module further processes the image to obtain a center of the image and marks the center of the image as a second point, the position processing module determines a relationship between the first point and the second point to obtain the position of the person in the image and makes the actuating device to control the fan to aim at the person; the shooting angle of the camera changes correspondingly, thus the distance between the first point and the second point in the image decreases; when the first point overlaps the second point in the image, the position processing module outputs a position signal to stop the movement of the actuating device, to keep the fan aiming at the person.

2. The system of claim 1, wherein the storage unit further comprises a person image storing module storing a number of images for different shapes of different people, the person detection module compares the image captured by the camera with the person images stored in the person image storing module to determine whether there is a person in the image.

3. A method for controlling a fan, the method comprising:

capturing an image of a scene at front of the fan through a camera mounted on the fan;

checking the image captured by the camera to determine whether there is a person in the image and outlining the person within a dashed box;

determining a position of the person in the image; and outputting a corresponding position signal to an actuating device of the fan for controlling the fan to change a direction of wind from the fan upon the condition that there is a person in the image;

wherein the step "determining a position of the person in the image" comprising:

processing the image to obtain a center of the dashed box in the image and marking the center of the dashed box as a first point;

processing the image to obtain a center of the image and marking the center of the image as a second point;

determining a relationship between the first point and the second point to obtain the position of the person in the image and making the actuating device to control the fan to aim at the person, the shooting angle of the camera changes correspondingly, thus the distance between the first point and the second point in the image decreases; and outputting a position signal to stop the movement of the actuating device to keep the fan aiming at the person when the first point overlaps the second point in the image.

4. The method of claim 3, wherein the step "checking the image captured by the camera to determine whether there is a person in the image" comprises:

comparing the image captured by the camera with a plurality of person images stored in advance to determine whether there is a person in the image.

5. A fan comprising:

a plurality of fan blades;

a casing receiving the fan blades;

a first actuating device to drive the fan blades;

a second actuating device to make the fan change direction, thus to adjust a direction of wind from the fan;

a camera mounted on the casing, to capture an image of a scene in front of the fan;

a controlling system to check the image to determine whether there is a person in the image, and to determine a position of the person in the image and output a corresponding position signal to the second actuating device for controlling the fan to change the direction of the wind from the fan, wherein the controlling system comprises:

a processing unit connected to the camera to receive the image; and a storage unit connected to the processing unit and storing a plurality of programs to be executed by the processing unit, wherein the storage unit comprises:

a person detection module to check the image captured by the camera to determine whether there is a person in the image; and a position processing module to determine a position of the person in the image, and output a corresponding position signal to the second actuating device for controlling the fan to change the direction of the wind from the fan;

wherein the position processing module processes the image to obtain a center of the dashed box in the image and marks the center of the dashed box as a first point, the position processing module further processes the image to obtain a center of the image and marks the center of the image as a second point, the position processing module determines a relationship between the first point and the second point to obtain the position of the person in the image and makes the second actuating device to control the fan to aim at the person, the shooting angle of the camera changes correspondingly, such that the distance between the first point and the second point in the image decreases, when the first point overlaps the second point, the position processing module outputs a position signal to stop movement of the second actuating device, to keep the fan aiming at the person.

6. The fan of claim 5, wherein the storage unit further comprises a person image storing module storing a number of images for different shapes of different people, the person detection module compares the image captured by the camera with the person images stored in the person image storing module to determine whether there is a person in the image.

* * * * *